United States Patent [19]

Pugh

[11] 3,955,312

[45] May 11, 1976

[54] GRIPPING HAND FOR DOLLS

[75] Inventor: William A. G. Pugh, Leicester, England

[73] Assignee: General Mills Fun Group, Inc., Minneapolis, Minn.

[22] Filed: Oct. 17, 1974

[21] Appl. No.: 515,742

[52] U.S. Cl. ..... 46/163; 46/156; 46/161

[51] Int. Cl.[2] ..... A63H 3/46

[58] Field of Search ..... 46/156, 161, 163

[56] References Cited

UNITED STATES PATENTS

| | | | |
|---|---|---|---|
| 2,945,321 | 7/1960 | Carter | 46/163 |
| 3,284,947 | 11/1966 | Dahl | 46/156 |
| 3,475,042 | 10/1969 | Speers et al. | 46/161 |

*Primary Examiner*—Louis G. Mancene
*Assistant Examiner*—Robert F. Cutting
*Attorney, Agent, or Firm*—Gene O. Enockson; L. MeRoy Lillehaugen

[57] ABSTRACT

A doll having a hand secured thereto which is capable of gripping or holding an object placed therein, without the need of any mechanical components. The hand is formed of a flexible plastic material which imparts prehensile characteristics to the hand and fingers. An object placed in the doll's hand is firmly held until a force of sufficient magnitude is exerted so as to remove the object therefrom.

11 Claims, 7 Drawing Figures

GRIPPING HAND FOR DOLLS

The present invention relates to toy figures, and more particularly to a doll having one or more hands adapted to firmly grasp or grip an object placed within the hand.

Numerous types of dolls are known in the art for simulating human characteristics. Such dolls include those capable of walking, talking, crying, wetting, eating, and the like. Various types of mechanisms are known for enabling a doll to grasp and/or release an object. According to the known prior art, such mechanisms include rather complex mechanical constructions which must be manipulated or actuated by a child. To the best of applicant's knowledge, such hands are not prehensile in the sense of being capable of firmly gripping objects of various shapes and sizes, without the aid of the mechanical components.

Accordingly, one object of the present invention is to provide a toy construction having a new and improved hand or other extremity attached thereto.

Another object is to provide a doll having a hand or other extremity attached thereto, which is prehensile in nature.

Other objects and advantages of the invention will become apparent from a consideration of the following specification and accompanying drawings. Before proceeding with a detailed description of the invention however, a brief resume of it will be presented.

According to one feature of the present invention there is provided a prehensile extremity, such as a hand, for attachment to a doll or toy comprising a plastic material having a Shore A hardness of from 35 to 70, preferably 40 to 65; a Lupke resilience of from 55 to 75 percent rebound, preferably 60 to 70; a tensile strength of from 40 to 120 kg/cm$^2$; and an elongation at break of from 400 to 750, preferably 550 to 650. A doll having such a hand is capable of grasping or holding an object until a force of sufficient magnitude is applied so as to wrest or remove the object from the hand.

The invention will best be understood by reference to the following drawings, wherein.

Before proceeding with a detailed description of the figures, a brief description of the material used in the invention will be presented. The plastic used in accordance with the present invention may be formed from thermoplastic rubber block copolymers comprising three blocks in the configuration A-B-A where A represents an amorphous polymer which has a glass transition temperature above room temperature (i.e. a thermoplastic), and B represents an amorphous polymer which has a glass transition temperatue well below room temperature (i.e. a rubber). The use of such a block copolymer enables prehensile extremities to be produced by conventional molding techniques.

The thermoplastic component of the block copolymer will generally be polystyrene. The rubber component will generally be a polydiene chain of either polybutadiene or polyisoprene. Suitable thermoplastic rubber block copolymers are marketed by Shell Chemicals UK Limited under the Trademark "KRATON". It has been found that the particular copolymers Kraton 3200 and Kraton 3226, which have the parameters set out in Table I, as well as compounds and mixtures thereof, are especially suitable. Other suitable copolymers which might be used are marketed by Polyfleet Limited.

TABLE I

| | Kraton 3200 Polyfleet 04/— | Kraton 3226 Polyfleet 01/— |
|---|---|---|
| Hardness, Shore A | 60–65 | 40–45 |
| Tensile Strength (kg/cm$^2$) | 105 | 45 |
| Elongation at break | 605 | 640 |
| Resilience, Lupke (% rebound) | 65 | 65 |

As stated hereinbefore, dolls' hands may be molded from thermoplastic rubber block copolymers of the type described above using conventional molding techniques. The hands may, if desired, be molded around an insert adapted to be attachable to a doll's arm. Alternatively, the hands may be molded such that the wrist portion is provided with an aperture adapted to receive an insert adapted to be attachable to a doll's arm. The insert is then inserted into the hand and secured thereto, e.g. by means of an adhesive. The insert should be formed of a polymer having a softening point higher than that of the thermoplastic rubber block copolymer, e.g. a nylon. Nylon 6 has been found to be particularly suitable for use as an insert, but other polymers such as polypropylenes and polyurethanes can be used if so desired.

Figure 1:
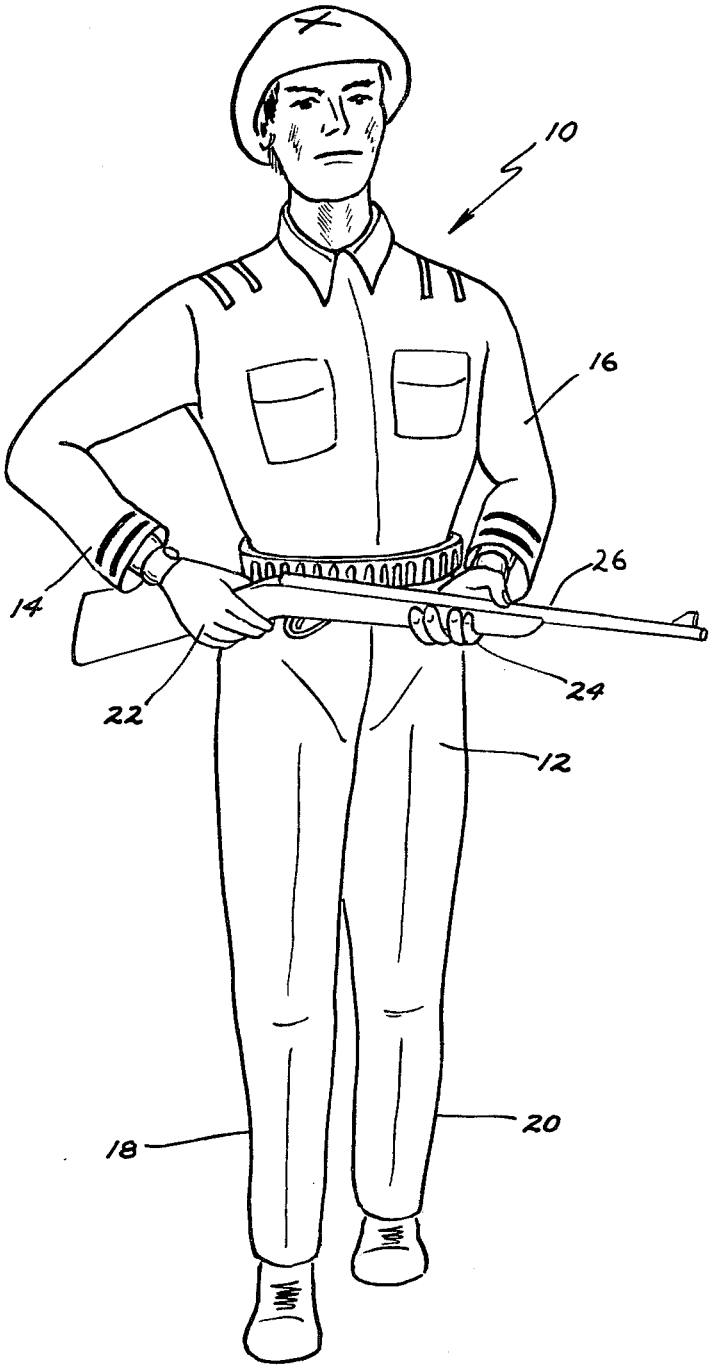
FIG. 1 is a front elevational view of a doll embodying my invention.

Reference is now made to the drawings. FIG. 1 illustrates an articulated doll 10 having the general configuration of a soldier. The doll 10 is provided with a torso 12 having a pair of arms 14 and 16 and a pair of legs 18 and 20 attached thereto, by means well known to those skilled in the art. The arms 14 and 16 are provided with hands 22 and 24 respectively, and they are shown as holding or grasping an item such as a weapon 26.

Figure 2:
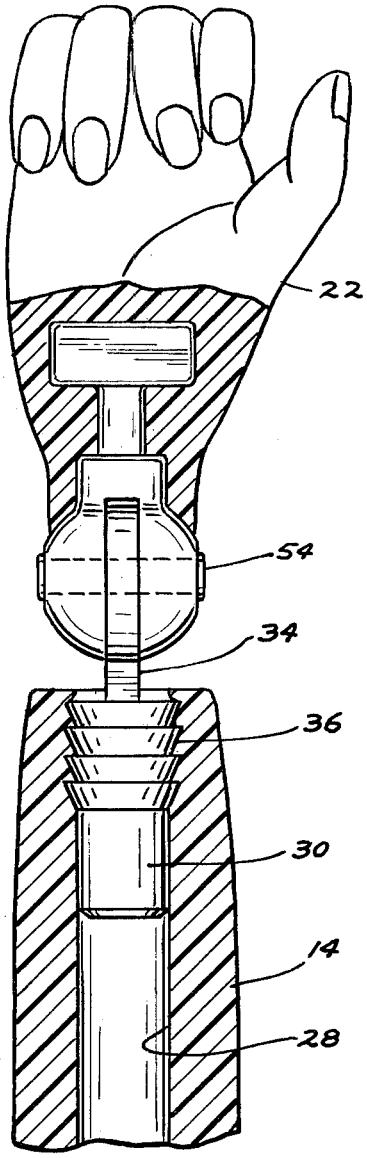
FIG. 2 is an enlarged partial sectional view of the right arm and hand of the doll shown in FIG. 1.
Figure 6:
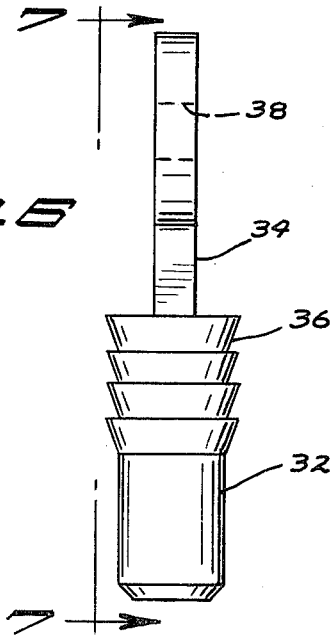
FIG. 6 illustrates an arm insert adapted to engage the hand insert of FIGS. 4 and 5.
Figure 7:
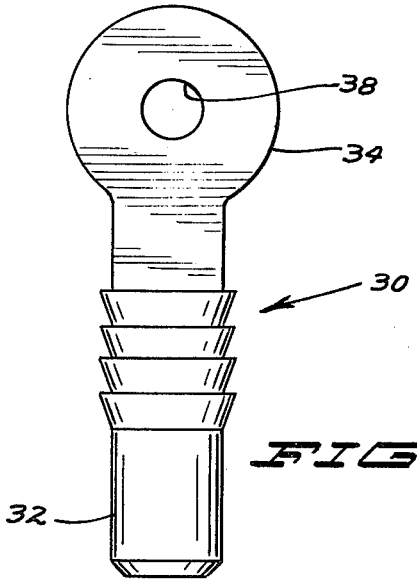
FIG. 7 is a side elevational view taken along line 7—7 of FIG. 6.

FIG. 2 illustrates the right arm 14 and hand 22, and the manner in which they are attached to each other, as well as to the arm 14 in greater detail. The arm 14 is hollow in that it has a cavity or opening 28 therein. An insert or plug, designated generally by numeral 30, is positioned within the arm 14. As shown more fully in FIGS. 6 and 7, the insert 30 includes a somewhat cylindrical base portion 32 and a flattened extension 34 integrally formed with the base 32. The base 32 is provided with a plurality of grooves which form teeth 36 in the surface of the base, and the extension 34 is provided with a bore 38.

Figure 4:
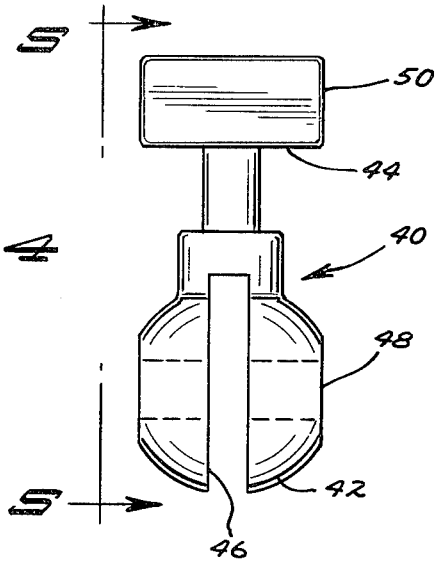
FIG. 4 is a front elevational view depicting the insert in greater detail.
Figure 5:
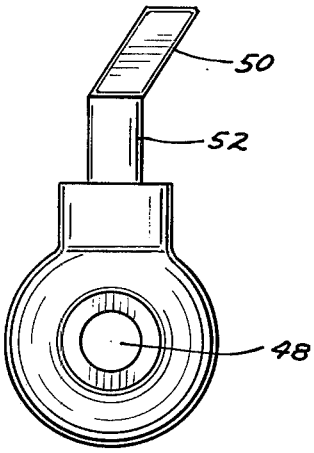
FIG. 5 is a side elevational view of the insert taken along line 5—5 of FIG. 4.

The flexible hand 22 is connected to the arm by means of an insert 40. As depicted more fully in FIGS. 4 and 5, the insert includes a somewhat spherical, bifurcated member 42 and a flattened T-shaped extension 44 integrally connected to the member 42. The bifurcated member 42 includes a slot 46 having substantially the same width as the width of the flattened extension 34, and a bore 48. As shown in FIG. 5, the cross member 50 of the extension 44 is offset slightly so that it lies in a slightly different plane relative to that of the leg 52; if preferred, of course, the member 50 could lie in the same plane.

Figure 3:
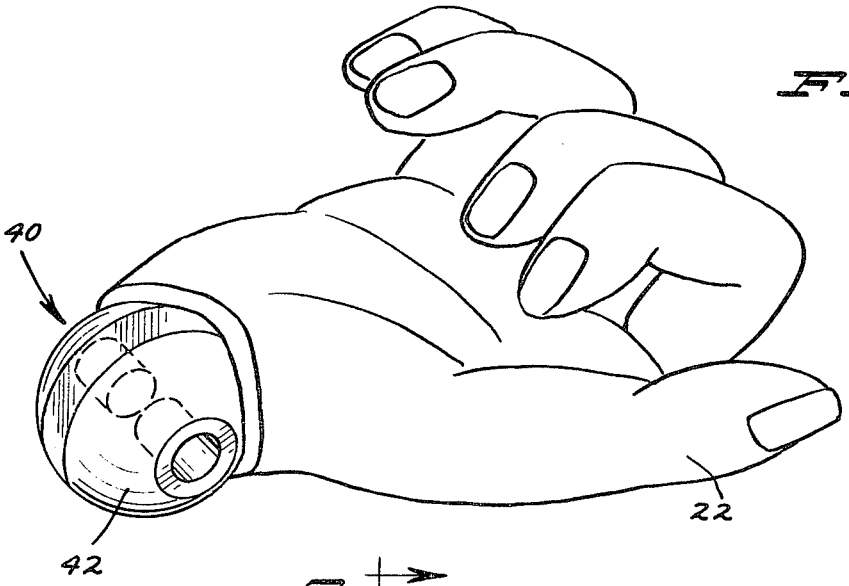
FIG. 3 is a perspective view of a hand molded around an insert, in accordance with the present invention.

As shown in FIG. 3, the hand 22 is molded around the insert 40, and the T-shaped member 44 aids in forming a proper connection between the hand and the insert. The hand 22, and more specifically the insert 40, is pivotally connected to the arm 14, and more specifically the insert 30, by positioning the extension 34 within the slot 46, and fastening them together by means of a rivet 54. The joint thus formed, corresponds to the wrist joint of a human being, in that the hand 22 can be pivoted about the axis of rivet 52. In addition, the hand, wrist and insert 30 can be rotated about the longitudinal axis of the insert, and the arm 14. As shown in FIG. 2, the forwardly projecting teeth 36 effectively prevent the insert from slipping out of the arm cavity 28.

As mentioned above, if desired, the hand can be molded separately, having an opening or cavity in the wrist section. An insert is likewise separately molded, and then inserted into the cavity. A commercially available adhesive can be used for bonding purposes. This procedure avoids the necessity of placing the insert into the hand molding apparatus while such hand is being molded. Moreover, it might be pointed out that if desired, the doll's hands may be hollow to allow for the provision inside the hand of means for making the hand, or an article gripped thereby, move.

As shown in FIG. 3, the hand is preferably formed so that two sets of fingers are molded together. In general, it is convenient to strengthen molded hands in accordance with the present invention by molding two or more fingers together. If preferred of course, each finger can be molded separately.

As will be readily appreciated, prehensile feet may also be formed from thermoplastic rubber block copolymers of the type described above, should it be desired to provide a doll, toy animal or the like with prehensile feed. It may also be desired to provide a toy animal with a prehensile tail; such tails may also be formed from thermoplastic rubber block copolymers of the type described above.

Dolls having hands formed by practicing the present invention, are able to grasp and hold an item in a realistic manner. While the articulated doll shown in FIG. 1 is shown as holding a weapon, it must be realized that numerous other articles such as binoculars, axes, dishes, or the like can also be held in a realistic manner. The desired object is merely placed in the doll's hand, by flexing or opening the fingers slightly, and placing the object therein. Thereafter, the fingers will close about the object and hold it until the object is wrested away from the doll. In this manner it simulates the capabilities of a human hand very closely.

In the above description and attached drawings, a disclosure of the principles of the invention is presented, together with some of the specific embodiments by which the invention might be carried out.

The embodiments of the invention in which an exclusive property or privilege is claimed are defined as follows:

1. A toy figure comprising a body, at least one extremity, means for attaching said extremity to said body, said extremity being prehensile in nature and formed of a plastic material having a Shore A hardness of from 35 to 70; a Lupke resilience of from 55 to 75; a tensile strength of from 40 to 120 kg/cm$^2$; and an elongation at break of from 400 to 750.

2. A prehensile extremity as claimed in claim 1 wherein said plastic material has a Shore A hardness of from 40 to 65.

3. A prehensile extremity as claimed in claim 1 wherein said plastic material has a Lupke resilience of from 60 to 70.

4. A prehensile extremity as claimed in claim 1 wherein said plastic material is formed from a thermoplastic rubber block copolymer comprising three blocks in the configuration A-B-A where A represents a thermoplastic amorphous polymer and B repesents a rubber.

5. A prehensile extremity as claimed in claim 4 wherein said thermoplastic amorphous polymer is polystyrene.

6. A prehensile extremity as claimed in claim 4 wherein said rubber is polybutadiene or polyisoprene.

7. A prehensile extremity as claimed in claim 1 wherein said plastic material has an elongation at break of from 550 to 650.

8. The combination of claim 1 wherein the toy figure is a doll, and the prehensile extremity is a hand.

9. The combination of claim 8 wherein the means for attaching the hand to the doll includes an insert positioned within said hand, a portion of said insert projecting from said hand, a portion of said insert projecting from said hand, and means for pivotally connecting said projection portion to the arm of the doll thereby forming a wrist joint.

10. The combination of claim 8 wherein the hand is molded so that at least two of its fingers are joined together.

11. The combination of claim 8 wherein the hand is substantially hollow.

* * * * *